US008814275B2

(12) United States Patent
Rees

(10) Patent No.: US 8,814,275 B2
(45) Date of Patent: Aug. 26, 2014

(54) METHOD AND APPARATUS FOR PRODUCING BRISTLE AREAS FOR BRUSHES

(75) Inventor: Bernhard Rees, Aitern (DE)

(73) Assignee: Zahoransky AG, Todtnau (DE)

( * ) Notice: Subject to any disclaimer, the term of this patent is extended or adjusted under 35 U.S.C. 154(b) by 178 days.

(21) Appl. No.: 13/256,129

(22) PCT Filed: Mar. 5, 2010

(86) PCT No.: PCT/EP2010/001398
§ 371 (c)(1),
(2), (4) Date: Sep. 12, 2011

(87) PCT Pub. No.: WO2010/105745
PCT Pub. Date: Sep. 23, 2010

(65) Prior Publication Data

US 2012/0013169 A1 Jan. 19, 2012

(30) Foreign Application Priority Data

Mar. 20, 2009 (DE) ..... 10 2009 013 723

(51) Int. Cl.
*A46D 3/04* (2006.01)

(52) U.S. Cl.
USPC ..... 300/5; 300/21

(58) Field of Classification Search
CPC ..... A46D 3/04; A46D 3/005
USPC ..... 300/17, 21, 2, 4, 5, 11
See application file for complete search history.

(56) References Cited

U.S. PATENT DOCUMENTS 3,408,112 A * 10/1968 Piotrowski ..... 300/21
RE27,455 E * 8/1972 Lewis, Jr. ..... 300/2
4,291,431 A * 9/1981 Lewis, Jr. ..... 15/159.1
4,609,228 A * 9/1986 Bickel ..... 300/4
4,979,782 A * 12/1990 Weihrauch ..... 300/4

(Continued)

FOREIGN PATENT DOCUMENTS

DE 4034811 A1 * 5/1992 ..... A46D 3/04
DE 43 30 171 A1 3/1995

(Continued)

*Primary Examiner* — Joseph J Hail
*Assistant Examiner* — Marc Carlson
(74) *Attorney, Agent, or Firm* — Volpe and Koenig, P.C.

(57) ABSTRACT

In a method for producing bristle areas for brushes, in particular toothbrushes, bundles of bristles (5) are divided off from a bristle supply (101), transported by a gas or air stream (Pf 1) and introduced into perforations (22) in a central plate (21). The bundles of bristles (5) are removed from the central plate (21) and transferred to a compactor plate (106) and, in the process, the density of the bundle of bristles (5) is increased. In the apparatus for producing bristle areas for brushes, in particular toothbrushes, having a bristle supply (101) and an apparatus (102) for removing individual bundles of bristles (5) from the bristle supply (101), and a transport apparatus (103) for transporting the bundles of bristles (5) into perforations (22) in a central plate (21) by a gas or air stream (Pf 1), a compactor plate (106) that has perforations (108) for receiving bundles of bristles (5) is arranged downstream of the central plate (21), with the cross-sections of the perforations being smaller than the cross-section of the bundle of bristles (5) supplied to the respective perforation (108). An apparatus is provided for forwarding the bundles of bristles (5) from the central plate (21) to the compactor plate (106).

21 Claims, 8 Drawing Sheets

(56) References Cited

U.S. PATENT DOCUMENTS

| | | | | |
|---|---|---|---|---|
| 5,033,797 | A * | 7/1991 | Rueb | 300/5 |
| 5,454,626 | A * | 10/1995 | Schiffer et al. | 300/21 |
| 5,683,145 | A * | 11/1997 | Boucherie | 300/2 |
| 6,178,583 | B1 * | 1/2001 | Volpenhein | 15/167.1 |
| 6,290,302 | B1 * | 9/2001 | Boucherie | 300/3 |
| 6,290,303 | B1 * | 9/2001 | Boucherie | 300/5 |
| 7,281,768 | B2 * | 10/2007 | Sato et al. | 300/4 |
| 7,921,499 | B2 * | 4/2011 | Huber et al. | 15/167.1 |
| 2002/0175557 | A1 * | 11/2002 | Motherway | 300/17 |
| 2003/0132661 | A1 * | 7/2003 | Sato et al. | 300/4 |
| 2008/0012420 | A1 * | 1/2008 | Boucherie | 300/4 |
| 2013/0139338 | A1 * | 6/2013 | Hess et al. | 15/167.1 |

FOREIGN PATENT DOCUMENTS

| | | | | |
|---|---|---|---|---|
| DE | 4330171 | A1 * | 3/1995 | A46D 3/04 |
| DE | 44 20 757 | A1 | 12/1995 | |
| DE | 4420757 | A1 * | 12/1995 | A46D 3/04 |
| DE | 297 12 554 | U1 | 11/1998 | |
| DE | 101 08 339 | A1 | 8/2002 | |
| DE | 10108339 | A1 * | 8/2002 | A46D 3/04 |
| EP | 0 405 204 | A2 | 1/1991 | |
| EP | 0674862 | * | 10/1995 | A46D 3/04 |
| EP | 2196108 | A1 * | 6/2010 | A46D 3/04 |

* cited by examiner

METHOD AND APPARATUS FOR PRODUCING BRISTLE AREAS FOR BRUSHES

BACKGROUND

The invention relates to a method for producing bristle areas for brushes, particularly toothbrushes, with the bundles of bristles being separated from a bristle supply and transported via a gas or air flow and inserted into perforations of a central plate as well as an apparatus for producing bristle areas for brushes, comprising a bristle supply and an apparatus for removing individual bundles of bristles from the bristle supply as well as a transport apparatus for transporting the bundles of bristles into perforations of a central plate via a gas or air flow.

Such a method including an apparatus are known, for example from EP 0 405 204 B1. Here, several bundles of filaments are transported via hoses into a carrier plate. Subsequently the bundles of filaments are connected to a thermoplastic carrier plate by way of melting and/or injection molding with a plastic material to form a brush head. The fill level of the perforations accepting the bundles of filaments is relatively low, due to the supply of the bundles of bristles using a gas or air flow, because the supply lines for transporting the bundles via a gas or air flow allow only a limited fill level without the lines becoming clogged or individual filaments being left behind in the supply line during transportation. The fill level represents the ratio of the cross-section of the perforation in a plate in reference to the total of cross-sections of all filaments held in this perforation. The low fill level leads to the consequence that during the injection molding of the filaments with jets of high pressure injection material passing through the filaments and becoming visible at the surface of the brush, which is unappealing or may render the brush useless.

DE 4330171 A1 describes a process and an apparatus for the production of brushes, in which bristle bundles are connected with a brush body in an injection molding process. In order to reduce the chances of the injection molding material passing into the region of the bristle bundles, bristle bundles held in carrying perforations of a bristle bundle holder are transferred with the help of a transport punch from the holder and into a sealing perforated plate, that has a perforation field corresponding to the perforation field of the bristle bundle holder, in which the cross-sections of the through perforations are slightly smaller so that the bristle bundles are somewhat sealed. The thereby sealed bristle bundles are carried to an injection molding machine and there injection molded.

In the brush manufacturing machine of DE 442057 A1, bristle bundles are positioned in perforations of a perforated plate located before a form plate, and through pressure pins are transferred to the bristle bundle receiving holes of a form plate. The bristle bundle receiving holes have at least sectionally a reduced cross-section in comparison to the perforations in the perforated plate, in order to seal the bristle bundles for molding.

A similar arrangement is provided in DE 29712554 U1. Also here the bristle bundles are transferred from a transport plate to a sealing plate using pressure pins in order to press them together.

Also in the method according to DE 10108339 A1. bristle bundles are impinged by stamps in order to be carried from a packing plate to a perforated plate. In that the holes in the packing plate are funnel shaped, the bristle bundles are sealed during transfer from the packing plate to the perforated plate.

In DE 4320171 A1, as well as in DE 4420757 A1, DE29712554 and DE 10108339, the bristle bundles are not carried by a gas or air flow to the bristle bundle holder. Here, this allows the individual bristle filaments to be conveyed more quickly than before or for transfer to the central plate individual bristle filaments can be held back, so that the bristle filaments can be arranged in the central plate offset from one another in a longitudinal direction.

SUMMARY

Therefore the objective of the invention is to provide a method and an apparatus of the type mentioned at the outset, by which a higher packing density of the bundles of bristles can be achieved and thus overshoots are avoided even under high injection pressures. In addition, it is desirable for bristle filaments to be arranged offset to one another in a longitudinal direction.

This objective according to the invention is attained with regards to a method that through the use of movable hole pins via hole pins that can insert into the perforations of the central plate, bristle filaments positioned offset in the axial direction to one another within a perforation of the central plate can be pushed together, and that the bristle bundles in the central plate, through the use of the hole pins that are movable through the perforations in the central plate, can be pressed into a compactor plate, that includes perforations to receive the bristle bundles, that have a smaller cross-section than the corresponding perforation carrying the bristle bundle so that the bristle density of the bundles of bristles is increased.

During the transport of the bundles of bristles via a gas or air flow into the central plate it may occur that individual bristle filaments are transported faster than others or during the transfer into the central plate individual bristle filaments may be held back so that bristle filaments may be present in the central plate, arranged offset in reference to each other in the longitudinal direction. In order to once again obtain aligned bristles in the central plate, without any bristles being offset in the longitudinal direction, the bristle filaments in reference to each other positioned offset in the axial direction within a perforation of the central plate are pushed together via hole pins that can insert into the perforations of the central plate.

While transferring the bundles of bristles into the compactor plate, the bundles of bristles are compacted, i.e. the entire bundle of bristles is slightly reduced with regards to its exterior circumference and thus the distance of the individual bristle filaments of a bundle of bristles is reduced in reference to each other. This way, during the subsequent injection molding of the bundles of bristles with plastic material to form a brush head or the entire brush body operation can occur with high injection pressure without the risk that injection material will be pushed through the bundles of bristles towards the outside and thus rendering the brush useless.

If necessary, the bundles of bristles held in the central plate can first be transferred into a contour plate, with individual bundles of bristles of the central plate being combined to form a joint, larger bundle of bristles in the contour plate and/or the cross-section of individual bundles of bristles is modified and the bundles of bristles are subsequently transferred from the contour plate into the compactor plate.

By the transfer into a contour plate, first several small bundles of bristles can be combined to form a larger bundle and/or special bundle contours, for example elliptical or star-shaped ones, according to the desired bristle area of the finished brush. This way, complex bristle areas can be realized, for example showing larger, continuous bristle areas.

It is possible for several bundles of bristles to be inserted successively and axially offset in reference to each other into each perforation of the central plate, which prior to the transfer into the contour plate or the compactor plate are pushed together via the hole pins that can penetrate the perforations of the central plate. This way, it is also possible to increase the bristle density of the bundles of bristles. It is also possible to successively insert different bundles of bristles, for example differently colored bundles of bristles, into a perforation of the central plate, which then are pushed together to form a joint multi-colored bundle of bristles.

Prior to injection molding the fastening ends of the bundles of bristles, these bundles of bristles may also be profiled at their operating ends and cut flush at their ends facing away from the operating ends. This way, a simple profiling of the bristle area is possible, for example by impinging the bundles of bristles with profiling pins or a profile plate comprising a counter-profile. Any expensive profiling after the injection molding of the bristle carrier or brush body by shearing the free ends of the bristles is not necessary.

After the compacting in the compacter plate, the bundles of bristles can be injection molded with plastic material, with here too higher injection pressures are possible without the injection material being pressed through the bristle filaments. If applicable, the bundles of bristles can also first be partially melted at their end at the side of the fastening before they are injection molded with an injection material, which further reduces the risk of over-spraying in the bristle area.

The partial melting or injection molding can directly occur in the compactor plate. However it is also possible to first transfer bundles of bristles from the compactor plate into the form cartridge.

With regards to the apparatus, the invention is characterized in that hole pins that are movable in the perforations of the central plate are provided for pushing together bristle filaments positioned offset in the axial direction to one another within a perforation of the central plate, and that a compactor plate is arranged downstream to the central plate that includes perforations for receiving the bristle bundles, that have a smaller cross-section than the corresponding perforation carrying the bristle bundle, and that an apparatus is provided with the hole pins that are movable in the perforations of the central plate for transferring the bristle bundles from the central plate to the compactor plate.

Here, the advantages develop already described in the explanation of the method according to the invention.

It is beneficial for the compactor plate to be arranged downstream in reference to a contour plate, with the contour plate comprising perforations, with at least one of them being sized to accept at least two bundles of bristles of the central plate and/or comprise a cross-section deviating from the cross-section of the corresponding perforation of the central plate.

The bundle of bristles are here first transferred from the central plate into the contour plate, where individual bundles of bristles can be combined to a joint, larger bundle of bristles, or the bundles of bristles can be provided with a particular exterior contour, for example oval or star-shaped, according to the desired bristle area of the finished brush. The bundles of bristles shaped in this way by the contour plate are then forwarded to the compactor plate, where the bundles of bristles are compacted, as described above.

Here, it is possible that a placement apparatus is provided for transferring the bundles of bristles from the contour plate into the compactor plate. After the contouring of the bundles of bristles in the contour plate it is moved into the area of the placement apparatus and the contoured bundles of bristles are transferred into the compactor plate, for example via hole pins that can be inserted into the perforations of the contour plate.

Alternatively, the contour plate and the compactor plate may be arranged successively in the longitudinal direction of the perforations in the contour plate and the apparatus for transferring the bundles of bristles from the central plate into the contour plate can also be embodied for transferring the bundles of bristles to the compactor plate. The transfer of the bundles of bristles from the central plate into the contour plate and therefrom into the compactor plate occurs here in a single step, rendering the transfer to be particularly fast, and a space-saving and structurally simple design of the apparatus can be implemented. Here, the contour plate can be embodied in a particularly space-saving fashion, because it only needs little space in the longitudinal direction of the bristles in order to deform the bundles of bristles, however it is not required to accept them in order to hold them, because the bundles of bristles are directly passed through the contour plate into the compactor plate.

In order to feed the bundles of bristles to the central plate the transportation apparatus may comprise at least one hollow line for a bundle of bristles. The end of the hollow line at the outlet side and the central plate may be embodied mobile so that they can be positioned adjustable in reference to each other in order to successively fill all perforations of the central plate with bundles of bristles.

In order to allow a faster filling of all perforations of the central plate with bundles of bristles it is beneficial for the transportation apparatus to comprise a number of hollow lines adjusted to the number of perforations of the central plate. This way, all perforations can be filled simultaneously. At the inlet side individual hollow lines may also comprise two or more line sections to accept one bundle of bristles each from the bristle supply, which combine at the outlet side to form a larger, joint line section in order to already fill individual larger perforations in the central plate with a respective amount of bristle filaments.

A structurally simple and cost-effective design results when the hollow lines represent hoses made from a flexible material. In particular, hoses made from plastic may be used.

However, the hollow lines may also comprise tubular connections made from steel, stainless steel, or another metal. Plastic hoses require a certain material thickness in order to withstand the pressure during the transport of the bundles via gas or air flow. When using hollow lines made from metal, their material thickness as well as their exterior diameter may be sized smaller, so that they can be arranged closer together at their ends and thus the perforations of the central plate may also be placed closer together. This way, the central plate overall may have smaller dimensions, which reduces the space required for the apparatus and allows the bristle areas to be arranged with bundles of bristles that are closer together.

A preferred embodiment provides that the transportation apparatus comprises a connector for the ends of the hollow lines facing away from the bristle supply and, at a distance therefrom, a vacuum chamber arranged to create a vacuum so that the central plate can be arranged between the connector and the vacuum chamber and that within the vacuum chamber a baffle plate is arranged as a stop for the bundles of bristles inserted into the perforations of the central plate.

The bundles of bristles are then transported via suction created in the vacuum chamber. In order for the bundles of bristles to remain in the central plate and not being suctioned further into the vacuum chamber a baffle plate is provided, which the bristles impinge and thus they are held in their end position.

Here, the baffle plate may be supported in a movable fashion in order to change the distance between the baffle plate and the central plate. The suction force of the gas or air flow can be controlled by the distance between the central plate and the baffle plate. The tighter the hollow lines are filled with bundles of bristles to be transported the greater the distance must be between the central plate and the baffle plate in order to ensure sufficient suction force.

By the baffle plate approaching the central plate until it contacts, after the transportation the bundles of bristles can be completely pushed back into the perforations of the central plate so that the central plate with the bundles of bristles can be positioned to the apparatus for transporting the bundles of bristles to the compactor plate and/or the contour plate.

In order to simplify the introduction of the bundles of bristles into the respective plate it is useful for each of the perforations of the central plate, the contour plate, and/or the compactor plate to comprise a bevel.

In order to allow bristle areas showing individual diagonally positioned bundles of bristles at least some perforations of the compactor plate may be arranged diagonally. This way, even more complex bristle areas can be realized, in which not all bundles of bristles are arranged parallel in reference to each other.

The bristle supply may have several material supplies for different bristle materials. For example, brushes can be produced with bundles of bristles comprising different materials or different colors.

During the filling of the perforations with bundles of bristles and/or the ventilation of the perforations the closer proximity may be impinged with ionized air.

A pulsing air pressure may impinge the bundles of bristles, with a counter-plate retaining the bundles in the central plate.

The counter-plate may serve as a retainer for the bundles and move back and forth.

One or more pins may be provided. One or more pins are held together in one or more pin holders. A pin guiding plate ensures that the pins are held in a form-fitting fashion above the perforations. The pins can push the bundles together to form a bundle. Here, a counter-plate may hinder the bundle from exiting the perforation during the pushing-together process.

A bundle may be given a homogenous alignment of the individual filaments by the pins and the counter-plate evenly moving back and forth.

A carrier plate may be provided to accept the bundles, with the bundles being pushed into the carrier plate.

Before the pins enter the perforation the carrier plate is positioned underneath the central plate. The pushing-together of individual bundles to form a joint bundle only occurs in the carrier plate. A baffle plate may also serve as a back support of the bundles in the carrier plate.

The closer proximity of the carrier plate may be impinged with ionized air.

The pins may have a different length and/or a respectively diagonal or curved contour, with the counter-plate showing a respective counter-contour. The counter-plate can be removed after the bundles of bristles have been pushed together and a blade can cut the projecting filaments underneath the central plate.

Instead of a counter-plate, the counter-contour can also be formed by counter-pins within the perforations.

Using a slide, the bundles of bristles can be pushed out of the compacting plate.

One or two slides below or above the compacting plate can remove a bundle from said compacting plate.

An insertion funnel may serve to accept the bundles of bristles. It can lower over the bundles of bristles and remove the bundles of bristles from the compacting plate.

A counterpart may hold a bundle of bristles in a clamping fashion against the compacting plate and/or against the slide.

Additionally, a hose connecting plate may also be provided.

The suctioning hose in the hose connecting plate can also be pushed next to the passage of the feeding funnel and thus a vacuum may develop in the suction hose even prior to the removal of the bundles.

As soon as a bundle is removed from the compacting plate the hose can be pushed in front of the passage of the feeding funnel.

The hoses may be connected with the form plate, with the geometric shapes of the hoses adjust to the geometric shapes of the perforations in the form plate.

The supply of the bundles in the hoses can occur simultaneously or gradually over time.

One or more additional substances can be inserted into the hoses via an additional access.

This may represent, for example, detergents, ionized air, lubricants, means to indicate the life of the bristles, or coatings for the bristles.

Prior to the transportation through the hoses the bundles may be stapled at one side or both sides. This connection is then loosened prior to getting pushed together.

The cross-section of the perforation in the central plate may be smaller than the cross-section of the hose, thus leading to the bundle of bristles splitting into two partial bundles of bristles. The cross-section of the holes in the central plate may be equivalent, for example, from 50% to 98% of the cross-section of the hose.

The geometry of the interior cross-section of the hose may be equivalent to the geometry of the perforation, for example be annular, or deviate therefrom.

The geometry of the perforation may be equivalent to one of the following geometries: a long hole, a constricted long hole, ellipse, crescent-moon shaped, triangular, polygonal, square, rectangular, star-shaped, diamond-shaped, serrated, shaped like a letter, shaped like a number.

The central plate may show several, including different shapes, as mentioned above.

The width of the central plate may be wider than the addition of the lengths of partial bundles of bristles arranged behind each other, particularly be equivalent from 1.1-fold to 2-fold of the total lengths of the bundles.

The perforations in the central plate may form an angle in reference to each other.

The perforations in the connector for the hoses may have different diameters and geometries.

When combining hoses, bundles of bristles with different features may be joined.

Bundles may be processed, which in addition to the cutting, are subjected to a processing at both and/or only at one end of the bundle. These processes may represent: rounded filaments; pointed filaments; chemically processed filaments; thermally processed filaments; slotted filaments; diagonally cut filaments; bundles with filaments of different lengths; straightly cut filaments; polished filaments; filaments provided with particles.

BRIEF DESCRIPTION OF THE DRAWINGS

In the following, the invention is explained in greater detail using the drawings. It shows, partially in a schematic fashion.

DETAILED DESCRIPTION OF THE PREFERRED EMBODIMENTS

Figure 16:
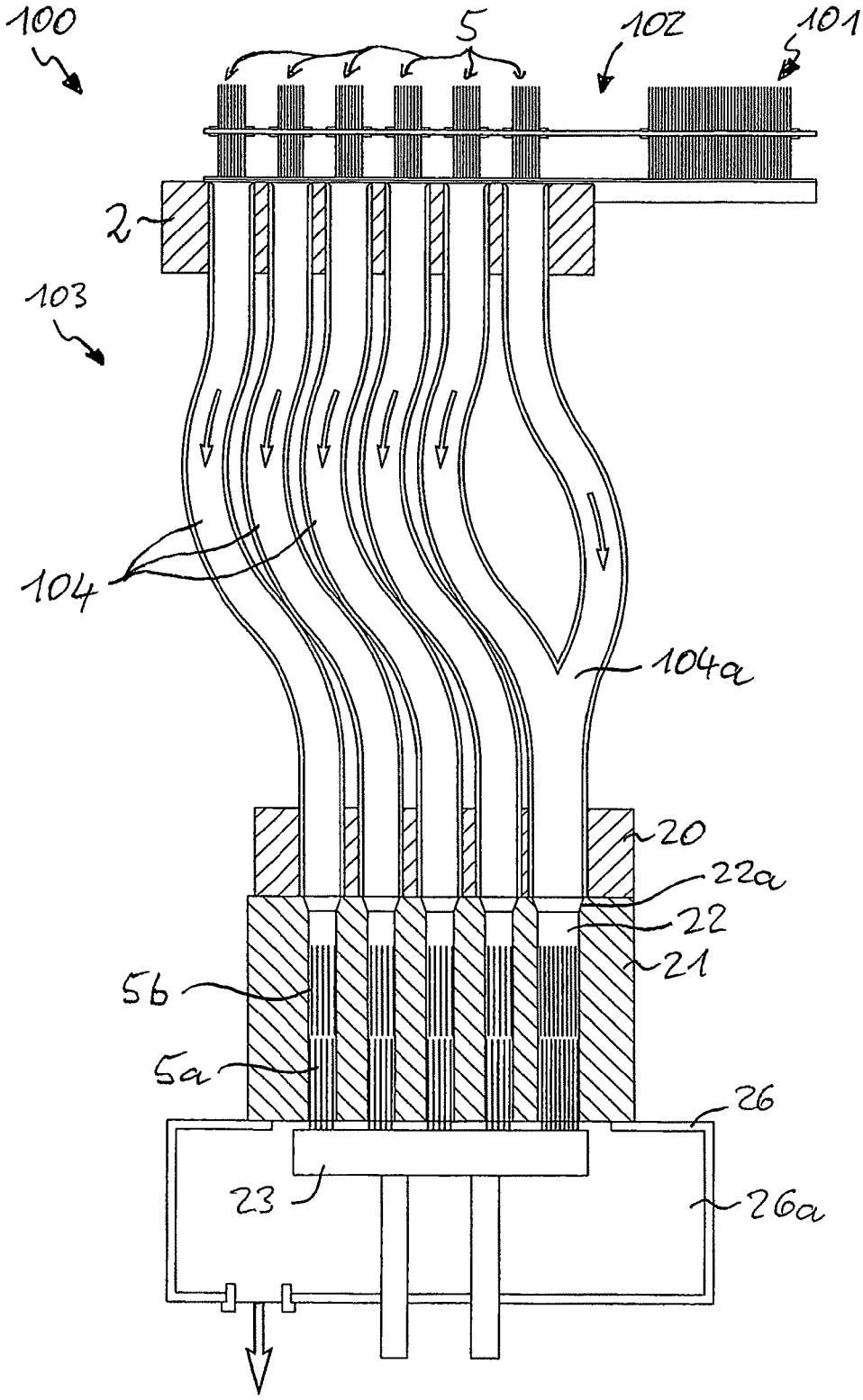

An apparatus, marked 100 in its entirety, for the production of bristle areas for brushes comprises, according to FIG. 16, a bristle supply 101 and an apparatus 102 for removing individual bundles of bristles 5 from the bristle supply 101 as well as a transport apparatus 103 for transporting the bundles of bristles 5 into perforations 22 of a central plate 21 using gas or air flow.

The provision of individual bundles of bristles 5 for the transportation to the central plate 21 is explained in greater detail in FIGS. 1 through 6.

Figure 1:
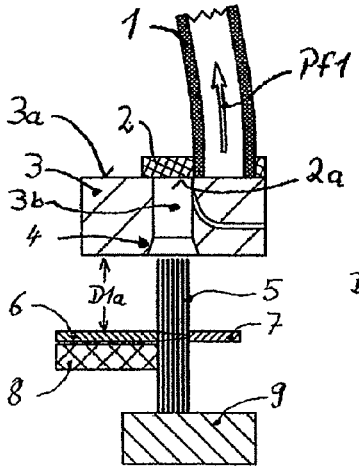
FIG. 1 a cross-section of a compartmented bundle of bristles provided underneath the feeding funnel, FIG. 2 a cross-section of a compartmented bundle similar to FIG. 1, however the feeding funnel is lowered over the bundle of bristles, FIG. 3 a cross-section of a compartmented bundle of bristles according to FIG. 2, however the bundle of bristles is taken from the circular arc or the circular disk, FIG. 4 a cross-section of a compartmented bundle of bristles according to FIG. 3, however the suction hose is above the feeding funnel, FIG. 5 a cross-section according to FIG. 4, however the bundle of bristles is suctioned off, FIG. 6 a cross-section according to the arrangement according to FIG. 5 with returning air flow, FIG. 7 a cross-section of an arrangement, in which bundles of bristles are suctioned via a central plate to a baffle plate, FIG. 8 a cross-section of an arrangement, in which the bundle of bristles in a central plate contact the baffle plate with the vacuum being switched off, FIG. 9 a cross-section of an arrangement in which the bundle of bristles is in a central plate between a distributor for pressurized air and a counter-plate, FIG. 10 a cross-section according to FIG. 9, however with a pulsing air flow, FIG. 11 a cross-section, in which the bundle of bristles is located in a central plate between a pin package and a counter-plate, FIG. 12 a cross-section according to FIG. 11, in which the pins have pushed the bundles of bristles together, FIG. 13 a cross-section, in which the bundles of bristles are pushed through a carrier plate to a baffle plate, FIG. 14 a cross-section of a form plate with form-fittingly inserted hose elements, FIG. 15 a form plate with geometrically different perforations, FIG. 16 a cross-section of an apparatus with a bristle supply, a transport apparatus, a central plate, and a vacuum chamber, FIG. 17 a cross-section of a central plate with a pin package engaging the perforations of the central plate, FIG. 18 the arrangement according to FIG. 17 with the bundles of bristles being pushed together by the pin package, FIG. 19 a cross-section of a central plate with bundles of bristles transferred to a contour plate and a compactor plate, FIGS. 20 to 25 bundles of bristles held in a compactor plate in various processing stages for profiling the bristle area, FIG. 26 a view of a removal plate with a contour plate contacting it, seen from the bottom of the contour plate, FIG. 27 a lateral cross-section of the arrangement of FIG. 26, FIG. 28 a top view of the arrangement of FIG. 27, and FIG. 29 a perspective illustration of the arrangement according to FIG. 27 with the removal plate and the contour plate being distanced from each other.

A compartmenting apparatus for bundles of bristles 5, shown in FIG. 1, taken from a material box by a circular arc or a circular disk 6, is positioned underneath the feeding funnel 3. The dropping of the bundle of bristles 5 is prevented by the floor plate 9. The distance D1*a* between the circular arc or the circular disk 6 and the feeding funnel 3 must be designed such that the bundle of bristles 5 can move freely underneath the feeding funnel 3.

The shift plate 8 contacts the bundle of bristles 5. The suction hose 1 is held in a hose holding plate 2. When a vacuum is created by the suction hose 1 by way of suctioning (Pf1), the bottom of the hose holding plate 2*a* and the top of the feeding funnel 3*a* contact each other.

Figure 2:
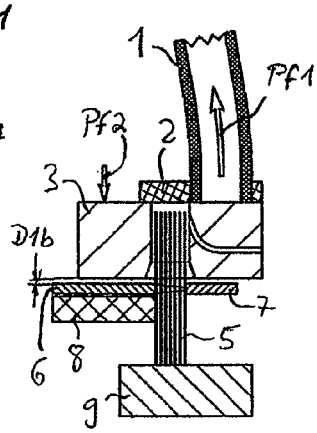

In FIG. 2 the feeding funnel 3 is pushed in the direction Pf1 downwards over the bundle of bristles 5. A minimal distance D1*b* between the circular arc or the circular disk 6 and the feeding funnel 3 must remain.

Figure 3:
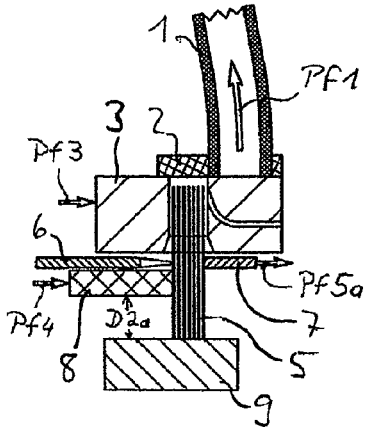

By the simultaneous movement of the feeding funnel 3, the shift plate 8, and the counter-part 7 in the direction of the arrows Pf3, Pf4, and Pf5 the bundle of bristles 5 separates from the circular arc or circular disk 6, as shown in FIG. 3. The bundle of bristles is held on the counter part 7 by the pressure of the shift plate 8.

Figure 4:
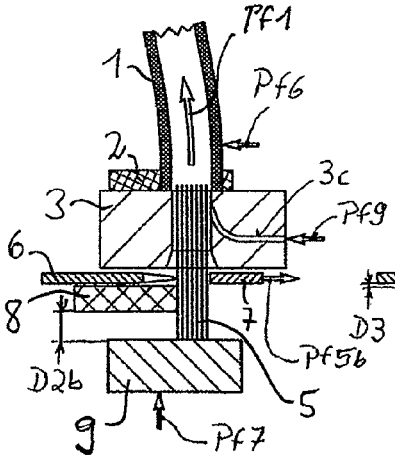

In FIG. 4, the suction hose 1 is placed over the feeding funnel 3. The counter-part 7 separates the clamping in the direction Pf5*b* and the floor plate 9 reduces the distance D2*a* from D2*b* in the direction Pf7 and thus pushes the bundle of bristles 5 into the suction hose 1.

Figure 5:
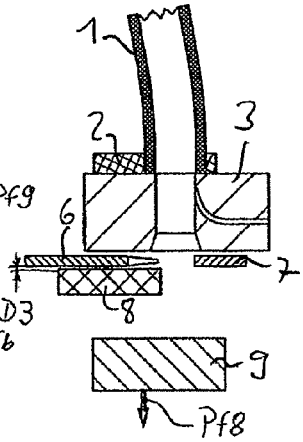

When the bundle of bristles 5 is suctioned off, as shown in FIG. 5, the floor plate 9 can be moved in the direction Pf8 into its original position.

Figure 6:
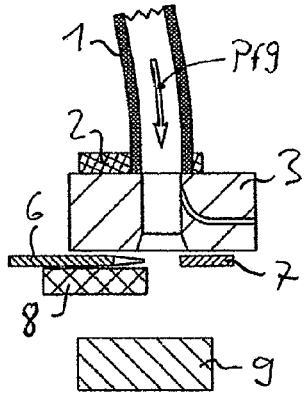

For cleaning purposes, according to FIG. 6, pressurized air is guided through the suction hose 1 in the direction of the arrow Pf9.

Figure 7:
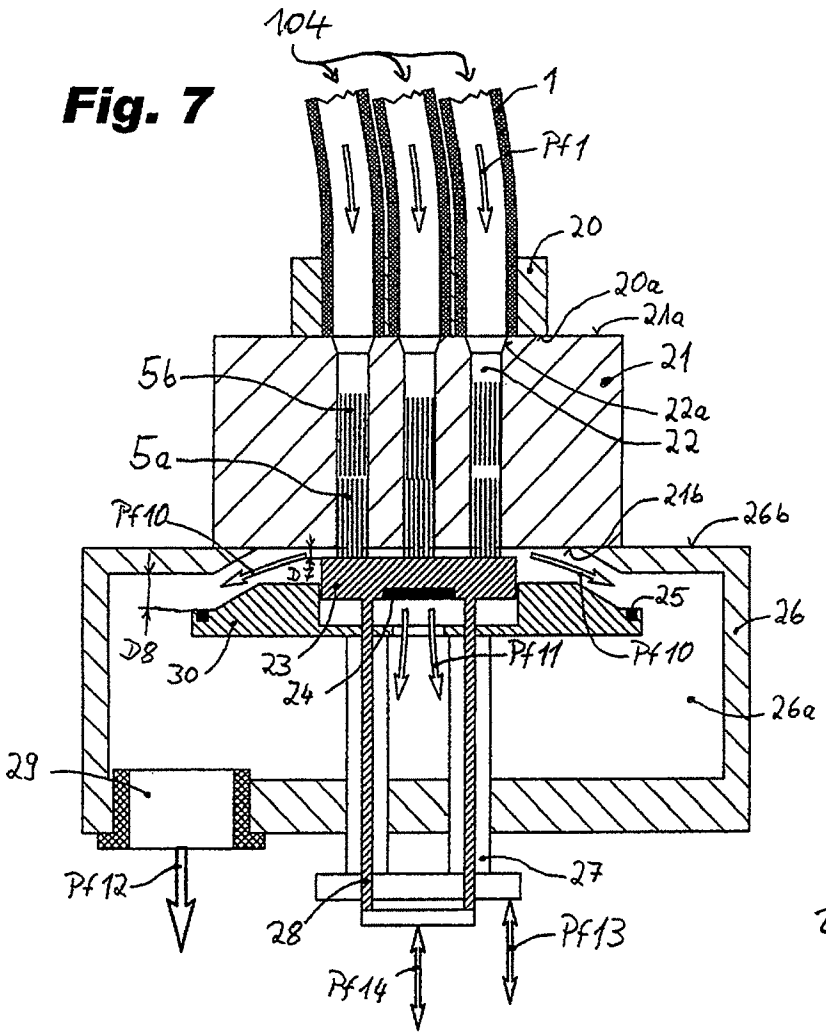

FIG. 7 shows the suction process of the bundle of bristles 5. The bundles of bristles 5 are transported through the suction hoses 1 in the direction Pf1 into the perforations 22 of the central plate 21 at the baffle plate 23.

Parts of the bundle of bristles 5 can be held back at the inlet bevel 22*a* of a perforation 22 of the central plate 21. The bundle of bristles 5 is divided into two sections: the frontal bundle 5*a*, which contacts the baffle plate 23, and the rear bundle 5*b*.

Air is permanently removed from the vacuum chamber via the suction connector 29 in the direction Pf12.

Air is removed circularly around the baffle plate 23 from the central plate 21 in the direction Pf10. In a porous baffle plate 23, additionally air can be removed from the central plate 21 through the sealing plate 24 in the direction Pf11.

The amount of air removed from the central plate 21 can be controlled by the motion of the sealing plate 30 in the direction Pf13. The guides 27 of the sealing plate 30 ensure that the sealing plate 30 is not rotated.

The distance D7 between the central plate 21 and the baffle plate 23 is very important. When the distance D7 is adjusted too small, the amount of air is insufficient to pull all filaments into the central plate. When the distance D7 is set too wide, filaments of the bundle of bristles 5*a* may bend and get suctioned in the direction Pf10 into the vacuum chamber.

The baffle plate 23 is guided via the guide 28 inside the guide 27 of the sealing plate 30. The guides may also occur separately.

Figure 8:
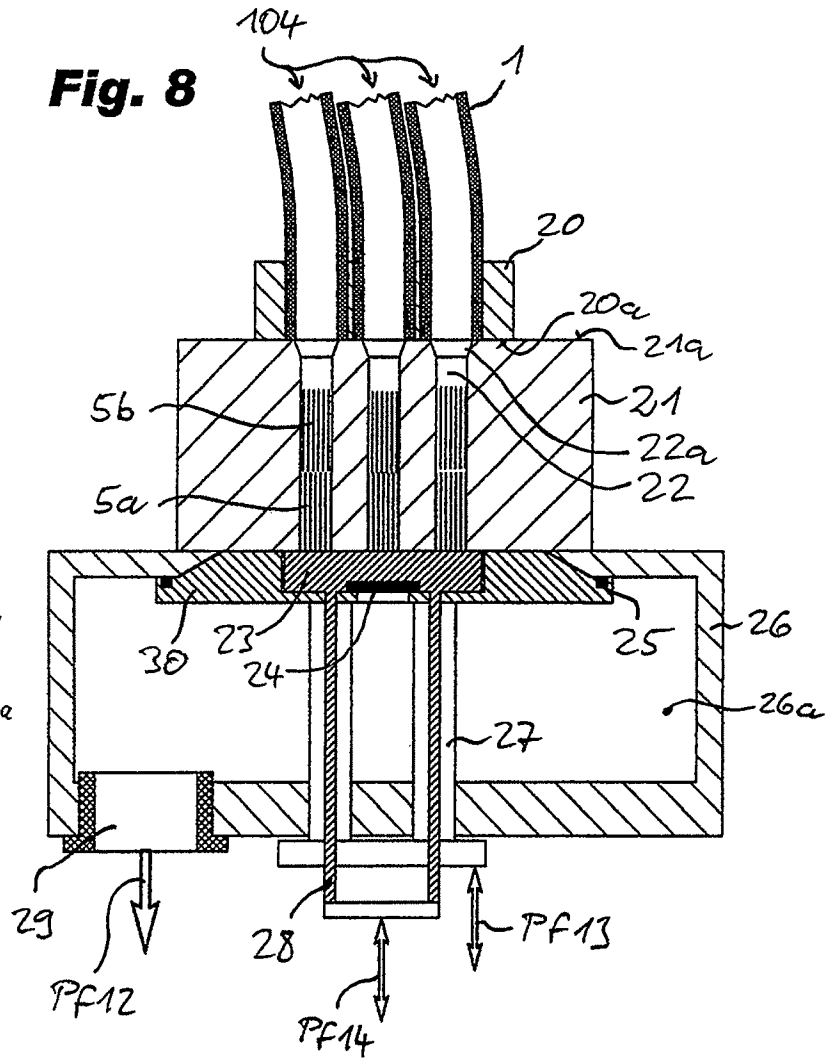

In the closed state, as shown in FIG. 8, the baffle plate 23 and the sealing plate 30 contact the central plate 21. The bundle of bristles 5*a* is bushed back into the central plate 21.

The seal 25 between the suction block 26 and the sealing plate 30 and the seal 24 between the baffle plate 23 and the sealing plate 30 separate the vacuum chamber 26*a* from the baffle plate 23 and the central plate 21.

In order to obtain safe ventilation of the central plate 21 and the hoses 1, annular ventilation should occur at the bottom 20*a* of the form plate 20. This ensures that during the ventilation the bundles of bristles 5*b* are not pushed back into the hose 1. A ventilation of the central plate 21 via the hoses 1 and the feeding funnel 3 is also possible, however that takes longer.

Figure 9:
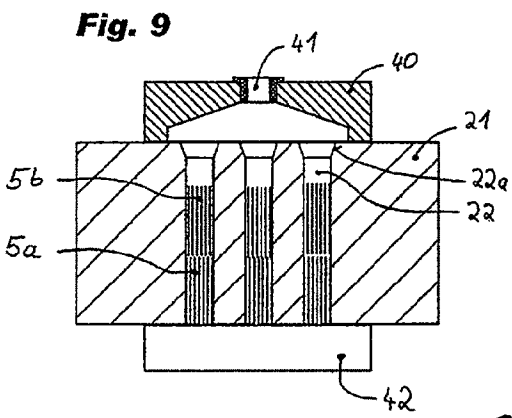

After the ventilation of the central plate 21 it may be removed laterally between the form plate 20 and the suction block 26 and pushed between the distributor for pressurized air 40 and the counter-plate 42, as shown in FIG. 9.

Figure 10:
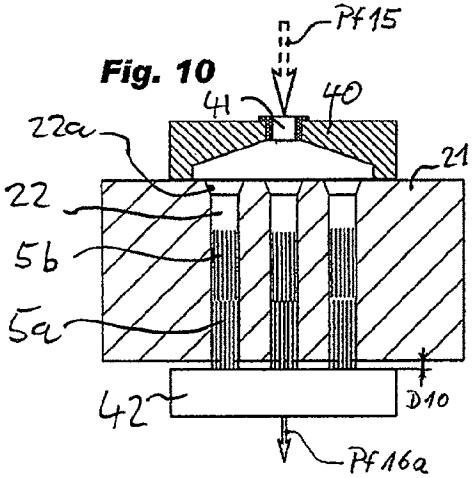

In FIG. 10, pulsing air flows in the direction Pf15 into the central plate 21. In order to allow the air to exhaust the counter plate 42 is separated from the central plate 21 to a distance D10.

Figure 11:
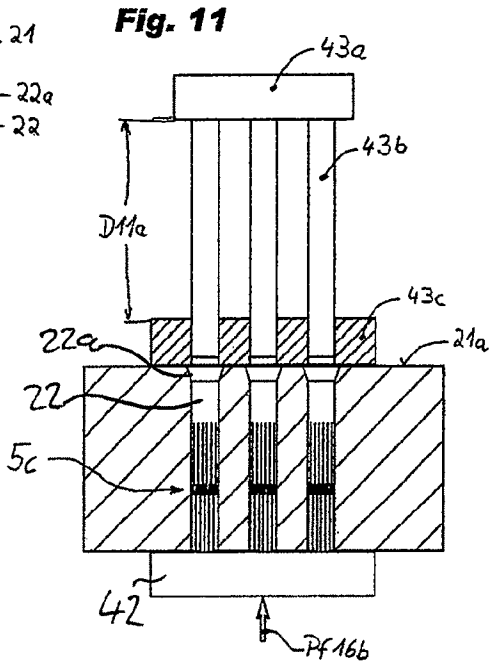

The pulsing of the air pressure Pf15 ensures that in the transitional area between the bundles 5*a* and the bundles 5*b* the filaments are easily pushed into each other (5*c*, FIG. 11). The pulsing of the air pressure Pf15 must occur until as many filaments as possible are pushed into each other.

In FIG. 11, a pin package with a pin guiding plate 43, individual pins 43*b*, and pin holders 43*a* is located at the top 21 of the central plate 21. The counter-plate 42 again contacts the central plate 21. In order to divide the production into several production steps, the counter-plate 42 of FIG. 10 can be exchanged for another counter-plate in FIG. 11.

Figure 12:
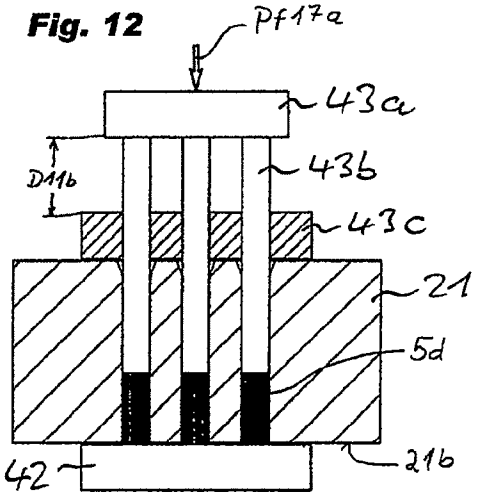

By way of lowering the pins 43*b* in the direction Pf17*a* the bundles 5*a* and 5*b* are pushed together to form a complete bundle of bristles 5*d*, see FIG. 12. Here, vibrating the counter plate 42 facilitates said process.

Figure 13:
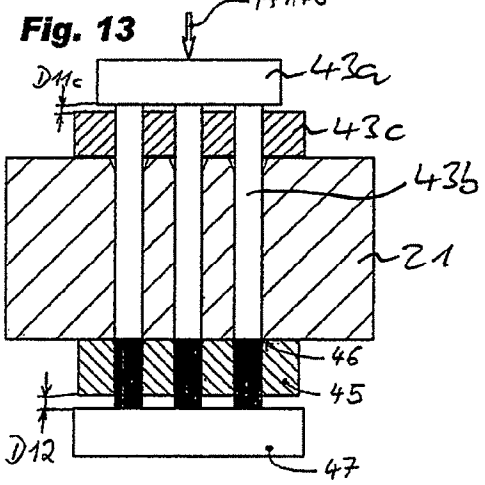

In FIG. 13, different from FIG. 12, the counter plate 42 is replaced by a carrier plate 45. A baffle plate 47 is positioned at a distance D12 from the carrier plate 45. The pins 43*b* press the bundle of bristles 5*d* into the carrier plate 45 until they contact the baffle plate 47. The bezel 46 in the carrier plate 45 facilitates the introduction of the bundle of bristles 5*d* into the carrier plate 45.

A repeated pushing back and forth of the pins 43*b* and the baffle plate 47 in the proximity of the distance D12 leads to the bundles of bristles 5*d* inside the carrier plate 45 to be arranged homogenously.

Figure 17:
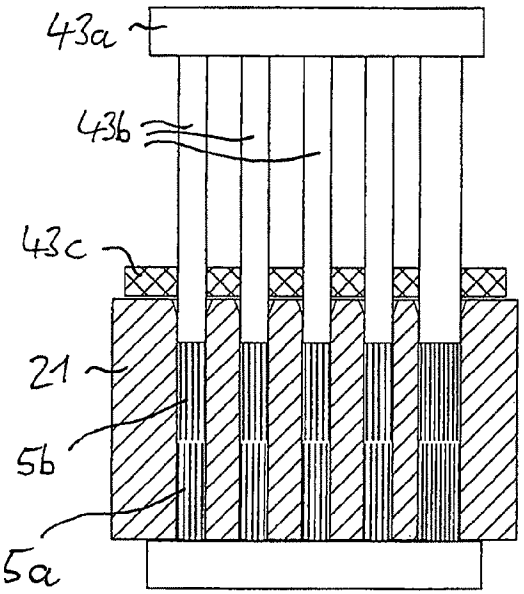
Figure 18:
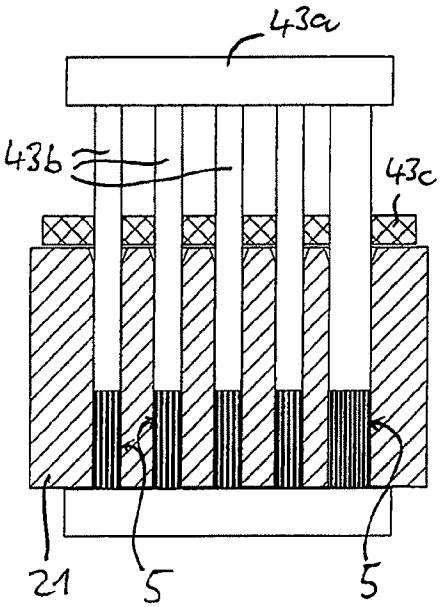

The pushing together of the partial bundles of bristles 5*a*, 5*b* to form a joint bundle of bristles 5 within the central plate 21 is also shown in FIGS. 17 and 18, similar to the illustration of FIGS. 11 and 12. The bundle of bristles 5 shown in FIGS. 17 and 18 at the right, however, comprises a larger diameter than the other bundles of bristles. Such larger bundles of bristles 5 may for example be composed from two smaller bundles of bristles 5 according to FIG. 16 using a Y-like branched hollow line 104*a*.

The hollow lines 104, 104*a* of the apparatus 100 according to FIG. 16 represent hoses made from a flexible material, which allows a simple and flexible assembly and is cost-effective. In spite thereof, a safe and reliable transportation of the bundle of bristles 5 is ensured.

Figure 19:
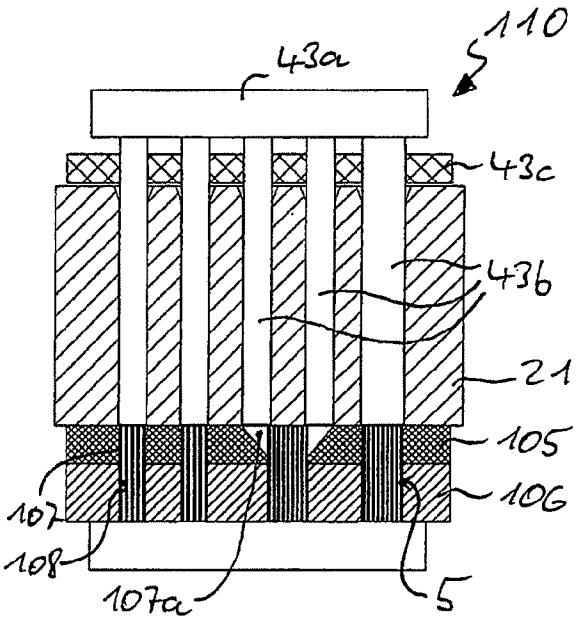

In FIG. 19 a contour plate 105 and a compactor plate 106 are arranged downstream in reference to a central plate 21, into which the bundles of bristles 5 are transferred via the pins 43*b*. The contour plate 105 comprises perforations 107, with one perforation 107*a* thereof being sized to accept two bundles of bristles 5 from the central plate 21. This way, bristles areas with differently sized partial bristle areas can be yielded, for example areas with elongated bristle sections.

Figure 20:
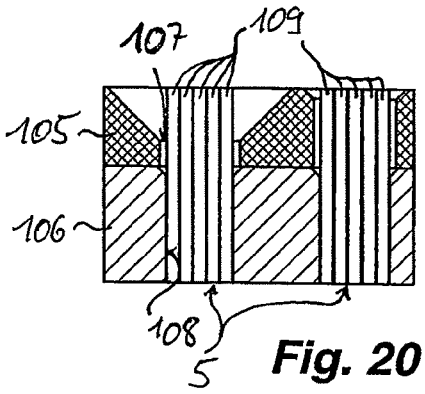
Figure 21:
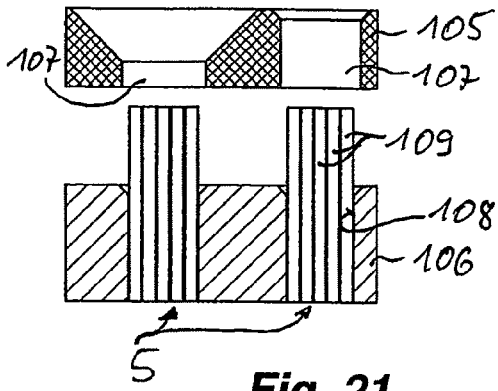
Figure 22:
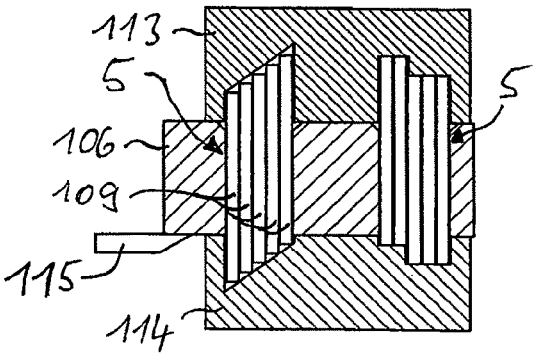
Figure 23:
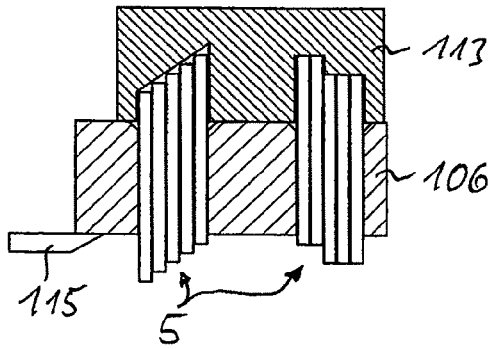
Figure 24:
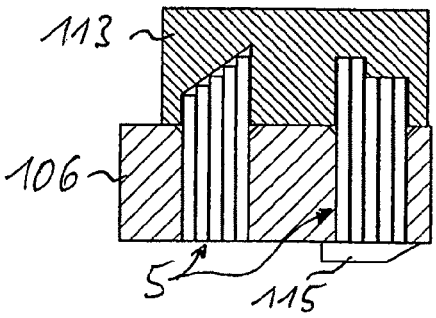
Figure 25:
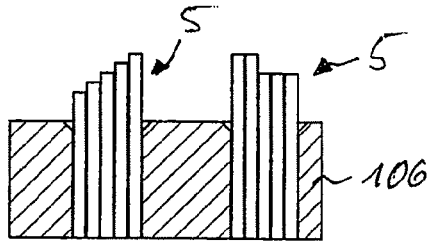

The bundles of bristles 5 are directly pushed out of the contour plate 105 into a compactor plate 106. However, its perforations 108 comprise one cross-section each, which is smaller than the corresponding perforation 107 of the contour plate 105, which is particularly discernible in FIG. 20. This way, the bristle density of the bundles of bristles 5 is increased, i.e. the individual filaments 109 of the bundles of bristles 5 are positioned closer together and have a shorter distance from each other. This way, during the later injection molding of the fastening ends of the bundles of bristles 5 it is avoided that even under higher injection pressures plastic material is pressed through the individual filaments and thus renders the brush useless.

The individual pins 43*b* with the pin holding plate 43*a* and the pin guiding plate 43*c* according to FIG. 19 form here a common apparatus 110 for transferring the bundle of bristles 5 from the central plate 21 into the contour plate 105 and the compactor plate 106.

Alternatively it is also possible for the bundles of bristles 5 first to be transferred from the central plate 21 into the contour plate 105, and for the contour plate 105 to be moved to another processing station, where the bundles of bristles are transferred into the compactor plate 106 using a separate transfer apparatus.

Figure 26:
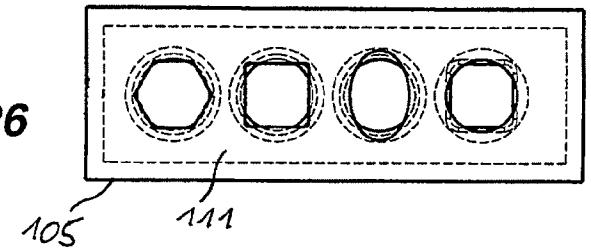
Figure 27:
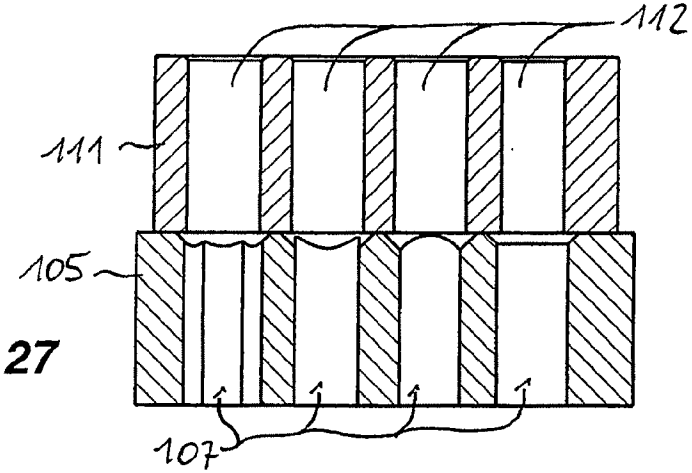
Figure 28:
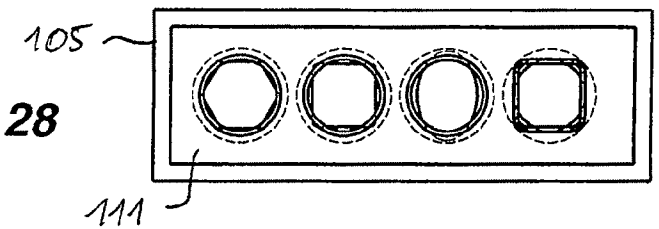
Figure 29:
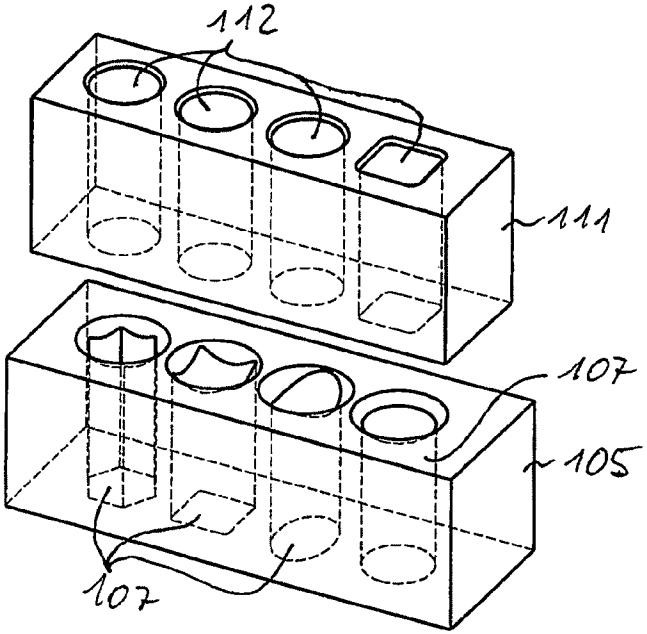

It is also possible that the bundles of bristles 5 are first transferred from a central plate 21 into a removal plate 111 and therefrom further transferred then into the contour plate 105. Such an arrangement is shown in FIGS. 26 through 29. FIG. 27 shows a cross-section of a removal plate 111 and the contour plate 105 arranged downstream. FIG. 26 shows a view from the bottom and FIG. 28 a view from the top. As particularly discernible from the perspective views according to FIG. 29, in which the removal plate 111 and the contour plate 105 are shown spaced apart from each other for better visibility, the perforations 107 of the contour plate 105 each show cross-sections different from the corresponding perforations 112 of the removal plate 111. During the transfer of the bundles of bristles from the removal plate 111 into the contour plate 105 the cross-section and/or the exterior contour of the bundle of bristles is changed, here. As shown in FIG. 29, for example round bundles of bristles can be reshaped into hexagonal, rectangular, or elliptic bundles of bristles or rectangular ones into round bundles of bristles.

After the reshaping of the bundles of bristles in the contour plate 105, they can be compacted as described above by another transfer into a compactor plate.

In FIGS. 21 through 25 it is shown schematically how the bundles of bristles 5 can be profiled after the transfer into the compactor plate 106. For this purpose, first the contour plate 105 is removed (FIG. 21), so that the bundles of bristles 5 are only held in the compactor plate 106. Subsequently the ends of the bundles of bristles 5, facing the user, are impinged with a profile plate 113 according to FIG. 22. In order to ensure a defined position of the individual filaments 109 of the bundles of bristles 5 said bundles of bristles are impinged from the opposite side with a counter-profile plate 114. After the removal of the counter-profile plate 114 (FIG. 23) the bundles of bristles 5 are cut with a knife 115, flush along the surface of the compactor plate 106 (FIG. 24), at their side facing away from the ends at the user side. For example, after the removal of the profile plate 113 (FIG. 25) the profiled bundles of bristles 5 can be transferred to a form plate, which is inserted in an injection molding form to injection mold the ends of the bundle at the fastening side and for injection molding a brush head or brush body.

Using such a profiling of the bristle area prior to the injection molding process, already cut bristle filaments can be processed in the bristle supply 101 as the source material and any subsequent profiling and cutting of the free ends of the bundles is not required after the injection molding of the brush body.

Figure 14:
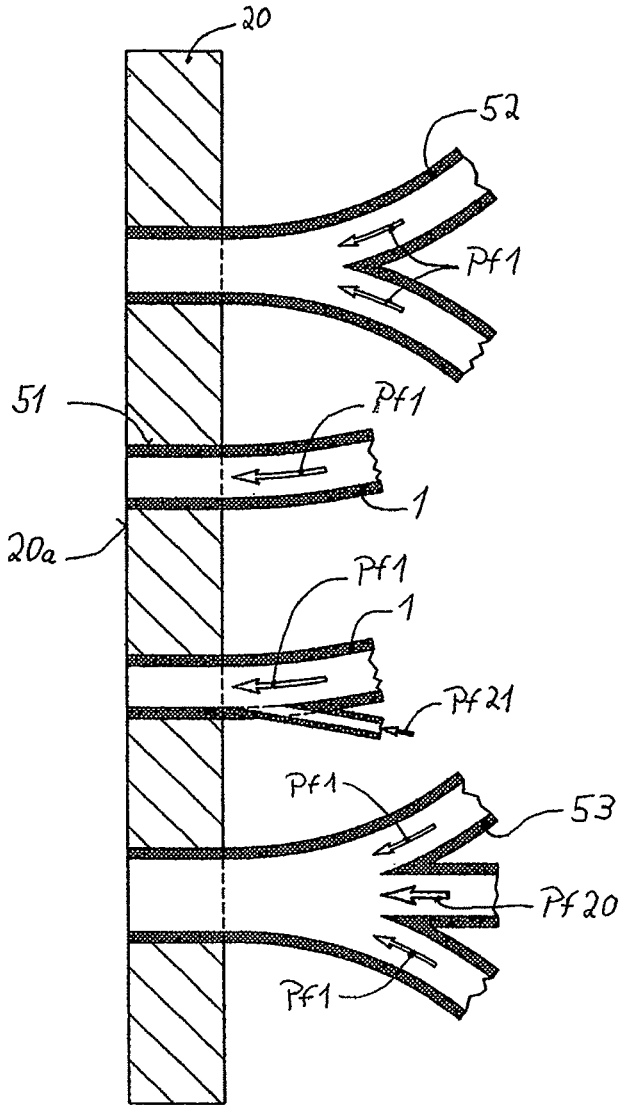

FIG. 14 shows how different hose systems, individual hose 1, double hose 52, and triple hose 53 are fastened at a form plate 20. Any number of multiple hoses is possible. Using multiple hoses individual bundles can be combined, as shown in the direction Pf1.

In order to remove the static charge of the bundle of bristles or to clean the bundle of bristles or to supply lubricants to the bundle of bristles it is possible, as indicated by the arrow Pf20, to supply gases, liquids, or powders via an additional line to the bundle of bristles.

Figure 15:
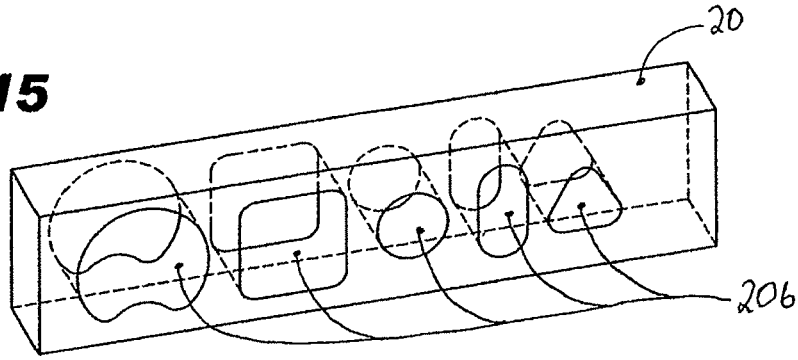

In order to allow realizing different geometric perforations 20*b*, as shown in FIG. 15, it must be ensured that the hoses 1, 52, 53, adhere tightly in the perforations 20*b* of the form plate 20. After the connecting of the hoses 1, 52, 53 potentially projecting hose pieces can be removed via a cut over the area 20*a* (FIG. 7).

If it shall be ensured that bundles with different features are combined and these bundles shall show a certain position in reference to each other, this can be realized as follows:

At the position at which the second bundle shall be located, a respective substitute pin is fastened to the baffle plate. This substitute pin has approximately the length of bundle 5*a* and bundle 5*b* combined.

The hose 1 of the first bundle 5 extends over the entire perforation 22. In the first filling, the substitute pin reserves the space for the second filling.

After the first filling has been concluded, the hose is positioned over the perforation 22 for the second filling. In this second filling the hose should show a cross-section equivalent to the one of the substitute pin and also be positioned over it.

When the second bundle has reached the tip of the substitute pin, said pin is retracted into the baffle plate 23.

The combination of the bundles 5*a* and 5*b* leads to no intermingling of the two fillings.

The invention claimed is:

1. A method for the production of bristle areas for brushes, comprising separating partial bundles of bristles (5*a*, 5*b*) from a bristle supply (101), transporting the partial bundle of bristles via a gas or air flow (Pf1) and inserting the partial bundles of bristles into perforations (22) of a central plate (21), wherein at least two of the partial bundles of bristles (5*a*, 5*b*) positioned offset in an axial direction to one another in the bristle supply direction are pushed together and inserted into the same perforation (22) of the central plate (21) and pressing the bristle bundles (5) in the central plate (21) into a compactor plate (106), using a plurality of hole pins (43*b*) inserted into and movable through the perforations (22) in the central plate (21) wherein the at least two of the partial bundles of bristles that were previously pushed together and inserted into the same perforation of the central plate are pressed into the compactor plate (106) using a single one of the hole pins (43*b*), and wherein the compactor plate (106), that includes a plurality of perforations (108) to receive the bristle bundles (5) from the central plate (21), with cross-sections of the perforations (108) that contact sides of the bristle bundles each being smaller than a cross-section of the bundle of bristles (5) supplied to the respective central plate perforation (22) so that a bristle density of the bristle bundles (5) is increased during insertion.

2. A method according to claim 1, wherein the bristle bundles (5) held in the central plate (21) are first transferred into a contour plate (105), with individual ones of the bristle bundles (5) of the central plate (21) being combined to form a joint, larger bundle of bristles (5) in the contour plate (105) and/or a cross-section of individual bundles of bristles (5) being modified, and the bundle of bristles (5) subsequently is transferred from the contour plate (105) into the compactor plate (106).

3. A method according to claim 2, wherein via the hole pins (43*b*) that are insertable into the perforations (22) of the central plate (21), pushing together several of the bundles of bristles (5) that are axially off-set in reference to each other, prior to the transfer into the contour plate (105) or the compactor plate (106) via the hole pins (43*b*) which can be inserted into the perforations (22) of the central plate (21).

4. A method according to claim 1, further comprising profiling the bundles of bristles (5) at their operating ends and flush cutting ends thereof facing away from the operating ends.

5. A method according to claim 1, further comprising at least one of partially melting the bundles of bristles (5) at their connecting ends or injection molding the bundles of bristles at their connecting ends with plastic material to form a brush head.

6. A method according to one of claim 5, wherein the bundles of bristles (5) are transferred from the compactor plate (106) into a molding cartridge prior to partially being melted and/or subjected to injection molding.

7. An apparatus for producing bristle areas for brushes, comprising a bristle supply (101) and an apparatus (102) for removing individual partial bundles of bristles (5*a*, 5*b*) from the bristle supply (101) as well as a transportation apparatus (103) for transporting the partial bundles of bristles (5*a*, 5*b*) into a plurality of perforations (22) of a central plate (21) via a gas or air flow (Pf1), wherein at least two partial bundles of bristles (5*a*, 5*b*) are positioned offset in an axial direction to one another in the bristle supply direction and combined and inserted into the same perforation (22) of the central plate (21), a plurality of hole pins (43*b*) that are insertable and movable in the perforations (22) of the central plate (21) are provided, with at least one of the hole pins adapted to singly transfer the at least two combined partial bundles of bristles (5*a*, 5*b*) into the compactor plate (106) to form a single bristle bundle, and a compactor plate (106) is arranged downstream in reference to the central plate (21), comprising a plurality of perforations (108) to accept the bristle bundles (5) from the central plate, with cross-sections of the perforations that contact sides of the bristle bundles each being smaller than a cross-section of the bundle of bristles (5) supplied to the respective central plate perforation (22).

8. An apparatus according to claim 7, wherein the compactor plate (106) is arranged downstream in reference to a contour plate (105), with the contour plate (105) comprising perforations (107), with at least one of the perforations being sized to accept at least two of the bundles of bristles (5) from the central plate (21) and/or comprising a cross-section different from a cross-section of a corresponding one of the perforations (22) of the central plate (21).

9. An apparatus according to claim 8, further comprising a transfer apparatus to transfer the bundles of bristles (5) from the contour plate (105) to the compactor plate (106).

10. An apparatus according to claim 9, wherein the contour plate (105) and the compactor plate (106) are arranged successively in a longitudinal direction of the perforations (107)

of the contour plate (107) and the apparatus for transferring the bundles of bristles (5) is embodied for transferring the bundles of bristles (5) from the central plate (21) to the contour plate (105) and also to transfer the bundles of bristles (5) to the compactor plate (106).

11. An apparatus according to claim 7, wherein the transport apparatus (103) comprises at least one hollow line (104) for one of the bundles of bristles (5).

12. An apparatus according to claim 11, wherein the transport apparatus (103) comprises a plurality of hollow lines (104) adjusted to a number of the perforations (22) of the central plate (21).

13. An apparatus according to one of claim 12, wherein the hollow lines (104) are hoses (1) made from a flexible material.

14. An apparatus according to claim 12, wherein the hollow lines (104) include tubular connections made from steel, stainless steel, or another metal.

15. An apparatus according to claim 12, wherein the transport apparatus (103) comprises a connector (20) for ends of the hollow lines (104) facing away from the bristles supply (101) and a vacuum chamber (26*a*) arranged at a distance therefrom to create a vacuum, the central plate (21) is arranged between the connector (20) and the vacuum chamber (26*a*), and inside the vacuum chamber (26*a*) a baffle plate (23) is arranged as a stop for the bundles of bristles (5) inserted in the perforations (22) of the central plate (21).

16. An apparatus according to claim 15, wherein the baffle plate (28) is supported movable to change a distance between the baffle plate (23) and the central plate (21).

17. An apparatus according to one of claim 8, wherein the perforations (22, 107, 108) of at least one of the central plate (21), the contour plate (105), or the compactor plate (106) each comprise a bevel (22*a*) at an inlet side.

18. An apparatus according to claim 7, wherein at least individual perforations (108) of the compactor plate (106) are arranged diagonally.

19. An apparatus according to one of claim 7, wherein the bristles supply (101) comprises several material supplies for different bristle materials.

20. An apparatus according to claim 7, further comprising an apparatus to profile operating ends of the bundles of bristles (5).

21. An apparatus according to claim 20, wherein the apparatus for profiling the operating ends of the bundles of bristles (5) comprises profiling pins or a profiling plate (113) for impinging the operating ends of the bundles of bristles (5) and a cutting apparatus (115) for cutting ends of the bundles of bristles (5) facing away from the operating ends.

* * * * *